US006319308B1

(12) United States Patent
McComas

(10) Patent No.: US 6,319,308 B1
(45) Date of Patent: Nov. 20, 2001

(54) COATING COMPOSITIONS CONTAINING NICKEL AND BORON AND PARTICLES

(76) Inventor: Edward McComas, 1286 SW. Evergreen Ln, Palm City, FL (US) 34990

( * ) Notice: Subject to any disclaimer, the term of this patent is extended or adjusted under 35 U.S.C. 154(b) by 52 days.

(21) Appl. No.: 09/741,333

(22) Filed: Dec. 21, 2000

(51) Int. Cl.[7] ..... C23C 18/32; C25D 15/00; B05D 1/18

(52) U.S. Cl. ..... 106/1.22; 106/1.27; 205/85; 205/109; 205/110; 205/224; 205/255; 205/259; 427/443.1

(58) Field of Search ..... 106/1.22, 1.27; 205/85, 109, 110, 224, 255, 259; 427/443.1

(56) References Cited

U.S. PATENT DOCUMENTS 3,562,000 * 2/1971 Parker ..... 427/383.7
3,674,447 * 7/1972 Bellis ..... 106/1.27
4,098,654 * 7/1978 Helle et al. ..... 205/50
4,302,374 * 11/1981 Helle et al. ..... 524/168
4,833,041 * 5/1989 McComas ..... 428/610
5,019,163 * 5/1991 McComas ..... 106/1.22
5,269,838 * 12/1993 Inoue et al. ..... 106/1.22
5,300,330 * 4/1994 Feldstein et al. ..... 106/1.22
5,580,375 * 12/1996 Feldstein et al. ..... 106/1.22
6,183,546 * 2/2001 McComas ..... 106/1.22

* cited by examiner

*Primary Examiner*—Helene Klemanski
(74) *Attorney, Agent, or Firm*—Sam Silverberg

(57) ABSTRACT

The invention is directed to corrosion and wear resistant metallic coatings containing nickel, boron, particles. The coatings are preferably deposited on catalytically active substrates from an electroless coating bath containing nickel ions, a stabilizer, a metal ion complexing agent, particles and a borohydride reducing agent, at a pH of about 10 to about 14.

28 Claims, No Drawings

COATING COMPOSITIONS CONTAINING NICKEL AND BORON AND PARTICLES

BACKGROUND OF THE INVENTION

This invention relates to novel metal coatings, which exhibit exceptional properties. More particularly this invention relates to metal coating compositions containing nickel, boron and particles and to the reductive deposition of said compositions on the surfaces of articles from alkaline aqueous solutions and the resulting articles.

The plating or deposition of metal alloys by chemical or electrochemical reduction of metal ions on the surface of an article to modify its surfaces characteristics for both decorative and functional purposes is well known in the art. Of particular commercial significance is the deposition of metal/metal alloy coatings on both metal and activated non-metal substrates to enhance surface properties such as hardness, resistance to corrosion, wear, and abrasive.

It is well known in the electroless metal plating art that solid particles can be co-deposited in nickel/phosphorus coating to change the properties of the coating. Particulate material such as diamond, silica carbide or Teflon or molly or tungsten disulfides have been used. The problem in the art is these co-deposited particles have poor bond strength and tend to separate from the nickel coating. This is thought to be due to the volume of particles lying at the interface of the nickel coating and the substrate thereby causing voids between the nickel coating and the substrate. This is can be seen under a cross section examination of the coating using a scanning electron microscope.

The prior art has recognized that when a borohydride reducing agent is substituted for a phosphorous reducing agent in a nickel plating bath a harder coating having greater wear resistance can be achieved. This is led to research and development effort in the area of nickel-boron coatings with the goal of producing still harder, more corrosion resistance coatings from a stable bath. For example, see, U.S. Pat. Nos. 6,066,400; 5,019,163; 4,833,041; 3,738,849; 3,674,447; 3,342,338; 3,378,400; 3,045,342; and 726,710. These references show conventional nickel/boron plating baths using conventional stabilizers. These disclosures are incorporated by reference.

In the development of nickel/boron coatings the prior art was faced with problem of stabilizing the bath due to the high reactivity of the borohydride reducing agent. The solution to the stability problem has been to add stabilizers such as thallium salts such as thallium sulfate, or lead chloride or lead tungstate to control the instability of the borohydride by slowing the reaction.

Controlling the stability of the borohydride requires balancing the need for a proper plating rate at the expense of stability by maintaining a proper amounts of stabilizer and boron reducing agent. To much stabilizer in the bath results in slower plating and the co-deposit of the stabilizer in the coating. An under stabilized bath tends cause the reaction to speed up causing seeding in the bath. Seeding is when the nickel plates out in the bath and forms small particles.

Also the balancing between the amounts of stabilizer and reducing agent must take in consideration the need to achieve about 3.5%–5.5% of baron in the coating to obtain optimum properties. Low baron causes softer coatings. To much boron causes the coating to be brittle.

The addition of stabilizers created new problems in the art by interfering with the formation of the nickel/boron coating. During the formation of the coating the stabilizer would co-deposit in the coating thereby negatively impacting the hardness of the coating.

Also as the bath ages there is a need to continuously add even additional stabilizers to achieve stability of the nickel/boron bath. During normal operation of the bath, boron and stabilizers are added every thirty minutes. In time the ability to achieve the proper amount of boron and nickel in the bath becomes very difficult. These baths usually become spend after 12 to 15 turnovers or less and have to be discarded. A turnover is when 100% of the available nickel in the bath is plated out and replenished. Although some of these baths could have a longer life, the cost of adding sufficient stabilizer to maintain the bath makes the plating uneconomical.

Another problem in the art was that many substrates such as such as certain aluminum alloys and tool steel alloys could not be heat treated without damage. To achieve the full hardness the nickel/boron coating should be heat treatment for ninety minutes at 725° F. This heat treatment forms nickel boride crystalline clusters through out the coating. The coating's hardness and wear resistance are due to these crystals.

This invention solves these problems in the art of adding particles with the desired properties to a nickel bath using a borohydride reducing agent so that these particles are co-deposited with the nickel and boron. These particles impart to the coating the desired properties. By selecting specific particles of a specified size and type the properties of the coating can be enhanced. For example, hard particles provide better wear resistance. Lubricant particle such as molly disulfide provide lubricious properties.

The problem with the bond strength of the co deposited particles in a nickel coating when using a phosphorous reducing agent is not present when a borohydride is used as a reducing agent. Under the same SEM examination as above, a sodium borohydride reducing agent produced a layer of nickel boron coating 2–3 microns thick at the interface and then the particles distributed in the coating. The auto catalytic reduction of nickel in the presence of sodium borohydride is an almost an instantaneous reduction thereby producing a continuous layer of nickel boron at the interface without significant particle co-deposition. The absence of the particles in this interfacial layer is believed to account for the excellent bond strength in contrast to a layer having particles at he interface produced by a sodium hypophosphate reducing agent.

An object of this invention is to provide a dispersing composition that conditions the particles before adding to an electroless or electrochemical nickel/boron plating bath. The reason for the conditioning is to impart desirable properties to the particles to overcome the harmful effects when particles are added to the bath. The particles tend to induce seed out or plate out or fall out or negatively impact the plating rate. Seed out occurs when the nickel ions in the bath comes out of solution and acts as nucleation sites for nickel deposition. Plate out is when the nickel plates everywhere and the bath becomes unstable. Fall out is when nickel plated particles become larger debris particle and either falls to the bottom of the tank causing the further nickel plating or the debris particles falling on the work-item resulting in a rough, undesirable coating.

The conditioning allows the particles to stay in suspension in the bath by the normal agitation from the pump & filter. The tendency of the particles to clump or float to the surface in the bath is substantially reduced by providing agitation to the bath. Usually this accomplished by controlling the flow of the liquid in the bath. However, other mechanical devices can be used such as a propeller or by moving the holder for the substrates in the bath to provide agitation.

SUMMARY OF THE INVENTION

According to the present invention there is provided an alkaline metal coating composition containing both nickel and boron and a stabilizer and particles. The coating composition can contain other metal ions, such as cobalt. The particles are introduced in the bath from a dispersing composition comprising particles in an alkaline solution and a mixture of a water soluble salt of ethylenediamine tetraacetic acid (EDTA) and ethylenediamine (EDA). This dispersing composition can be added to any conventional stabilized nickel boron baths to form the coating composition. The coating composition is coated on a substrate by electroless or by electrochemical deposition to produce and amorphous and continuous and uniform coating. The coating can be heat treated to improve the properties.

The invention is directed to a dispersing composition that allows particles such as diamonds, boron carbide, silica carbide to be co-deposited in a nickel/boron coating without inducing seed out or plate out or fall out or negatively impacting the plating rate. Seed out occurs when the nickel ions in the bath comes out of solution and acts as nucleation sites for nickel deposition. Plate out is when the nickel-plates everywhere and the bath becomes unstable. Fall out is when nickel plated particles become larger debris particle and either falls to the bottom of the tank causing the further nickel plating or the debris particles falling on the work-item resulting in a rough, undesirable coating.

The dispersion composition comprises a dispersing agent and the particles. Other constituents can include water and an alkaline agent to modify the pH such as sodium hydroxide or ammonium hydroxide. The pH of the dispersion is preferably above 10. The dispersing agent is a of mixture of a water soluble salt of EDTA and ETA. The water soluble salt of EDTA is preferably a metal salt.

The size of the particles effect the properties of the coating. As the particles increase in size the coating becomes abrasive to the surface to be contacted. Usually this occurs when the particles are greater then 10 microns. The preferred size for a non abrasive coating is 1 micron or less. The maximum size of the particles that could be used in constrained by the ability to maintain the particles in suspension and be codeposited in the coating.

The amount of particles in the plating bath can usually range between about 0.05 to about 0.15 grams per gallon of bath. Too much particles causes the bath to decompose. A small amount of particles does not produce the desirable properties.

The metal coating of the present invention comprises any conventional heated or non heat treated nickel boron coating having co deposited particles dispersed in the coating. Usually the conventional nickel boron coatings have about 85 to about 99.5 weight percent nickel, about 0.5 to about 10 weight percent boron, and optionally a stabilizer. The coatings are uniform and continuous. A preferred range for the nickel coating is 93–96 weight percent nickel and 2–5 weight percent boron and particles. At the interface between the substrate and the nickel/boron coating a layer free of particles is formed. The interfacial layer is about 1–3 microns thick. Usually this layer is 1–2 microns in thickness. The maximum volumetric amount of particles found in the nickel coating is about 37½%.

The present coating is made by contacting a substrate with a coating bath containing nickel ions, particles, a metal ion complexing agent, a stabilizer, a borohydride reducing agent, and optionally other metal ions at pH about 10 to about 14 and at an elevated temperature of about 180 to about 210° F. The coating can be plated at lower temperatures after the plating has been initiated within a temperature range of about 180 to about 210° F.

DETAILED DESCRIPTION OF THE INVENTION

Suitable substrates for electroless deposition are those with so-called catalytically active surfaces including those composed of nickel, cobalt, iron, steel, aluminum, zinc, palladium, platinum, copper, brass, chromium, tungsten, titanium, tin, silver carbon, graphite and alloys thereof. Those materials function catalytically to cause a reduction of the metal ions in the plating bath by the borohydride and thereby result in deposition of the metal alloy on the surface of the substrate in contact with the plating bath. Aluminum usually requires a protective strike coat to prevent dissolution before plating. Non-metallic substrates such as glass, ceramics and plastics are in general, non-catalytic materials; however, such substances can be sensitized to be catalytically active by producing a film of one of the catalytic materials on its surface. This can be accomplished by a variety of techniques known to those skilled in the art. One preferred procedure involves dipping articles of glass, ceramic, or plastic in a solution of stannous chloride and then contacting the treated surface with a solution of palladium chloride. A thin layer of palladium is thereby reduced on the treated surface. The article can then be plated or coated with the metallic composition in accordance with this invention by contact with a coating bath as detailed below. It is to be noted that magnesium, tungsten carbide and some plastics have exhibited some resistance to deposition of the present coatings.

Any conventional nickel plating bath for electroless deposition using a borohydride reducing agent can be used for co-deposition of the hard particles. Conventional nickel plating usually have the following constituents.

(1) an effective amount of nickel ions, about 0.175 to about 2.10 moles per gallon. Calculations were based on a nickel chloride range of 0.05 to 0.6 pounds per gallon. A preferred range of nickel ions is about 0.35 to about 1.57 moles per gallon based on 0.1 to about 0.45 pound per gallon of nickel chloride.

(2) An effective amount of a chemical agent for adjusting the pH of the bath to between about 10 and about 14;

(3) an effective amount of usually about 2.26 to about 6.795 moles per gallon metal ion complexing agent, preferably 3.3 to 3.8 moles per gallon (4) an effective amount of reducing agent usually about 0.03 to about 0.1 moles per gallon of coating bath of a borohydride reducing agent based on BH4 preferably 0.045 to 0.08 moles per gallon of bath;

(5) an effective amount of a stabilizer, usually up to 6%

(6) optionally other metal ions

The borohydride reducing agent can be selected from among the known borohydrides having a good degree of water solubility and stability in aqueous solutions. Sodium borohydride is preferred. In addition, substituted borohydrides in which not more than three of the hydrogen atoms of the borohydride ion have been replaced can be utilized. Sodium trimethoxyborohydride [$NaB(OCH_3)_3H$] is illustrative of that type of compound.

The coating bath is prepared to have a pH of about 12 to about 14. Best results have been observed when the pH of the bath is maintained during the coating process within that range and more preferably at about pH 13.5. Adjustment of bath pH can be accomplished by addition of any of a wide variety of alkaline salts or solutions thereof. Preferred chemical agents for establishing and maintaining bath pH are the alkali metal hydroxides, particularly sodium and potassium hydroxide, and ammonium hydroxide. Ammonium hydroxide offers and additional advantage in that the ammonium ion can function to assist metal ion complexing in the coating bath.

Due to the high alkalinity of the coating bath, a metal ion complexing or sequestering agent is required in the bath to prevent precipitation of the metal ions such as nickel and other metal hydroxides or other basic salts. Importantly, too, the metal ion complexing agent functions to lower metal ion reactivity; the complexed or sequestered metal ions have minimal reactivity with the borohydride ions in the bulk solution but do react at the catalytic surfaces of substrates in contact with the solution. The term catalytic surface refers to the surface any article composed of the aforementioned catalytic materials or to the surface of a non-catalytic material which has been sensitized by application of a film of said catalytic materials on its surface.

The complexing or sequestering agents suitable for use in this invention include ammonia and organic complex-forming agents containing one or more of the following functional groups: primary amino, secondary amino, tertiary amino, immino, carboxy and hydroxy. Many metal ion complexing agents are known in the art. Preferred complexing agents are ethylenediamine, diethylene triamine, triethylene tetramine, the organic acids, oxalic acid, citric acid, tartaric acid and ethylene diamine tetraacetic acid, and the water soluble salts thereof. The most preferred is ethylene diamine.

About 2.26 to about 6.795 moles per gallon of complexing agent are used per gallon of coating bath. This calculation was based on 0.3 to about 0.9 pound per gallon of ethylenediamine. Best results have been obtained when about 3.39 to about 3.77 moles per gallon of coating bath. This calculation was based on about 0.45 to about 0.5 pound per gallon of ethylenediamine for each gallon of coating bath.

The metal ions, like nickel, in the coating bath are provided by the addition to the bath by the respective water soluble salts. Any salts of those metals having an anion component which is not antagonistic to the subject coating process is suitable. For example salts of oxidizing acid such as chlorate salts are not desirable since they will react with the borohydride reducing agent in the bath. Nickel chlorides, sulfates, formates, acetates, and other salts whose anions are substantially inert with respect to the other ingredients in the alkaline coating bath are satisfactory.

The stabilizer is usually added to the bath from a concentrate. The stabilizer and their effective amounts are can include those found in the prior art. Examples of stabilizers are lead tungstate or lead sulfate tungstate or lead chloride tungstate.

The coating bath is typically prepared by forming an aqueous solution of the appropriate amounts of metal salts, adding the complexing agent(s) then the particle dispersion composition and then the stabilizer, adjusting the pH to about 12 to about 14, heating to about 195° F., filtering and finally, immediately before introducing the substrate into the bath, adding the required amounts of sodium borohydride (typically in aqueous alkaline solution). The sodium borohydride can be added with the stabilizer. The bath can be agitated using conventional techniques by controlling the velocity and flow of the liquids introduced in the bath.

The article to be coated or plated using a bath in accordance with this invention is usually prepared by mechanical cleaning, degreasing, anode-alkaline cleaning, and finally pickling in an acid bath in accordance with the standard practice in the metal-plating art. The substrate can be masked if necessary to allow deposition of the metal alloy coating only on selected surfaces. Although the present coatings in general exhibit excellent adhesion to properly prepared substrate surfaces, in instances where coating adhesion is critical or where some adhesion problems are experienced, coating-adhesion can often be enhanced by depositing a nickel strike electrochemically on the substrate surface prior to applying the present coating.

The cleaned or otherwise surface-prepared article is immersed in the hot (about 180 to about 210° F.) coating bath to initiate the coating process. The process is continued until deposition of the coating has progressed to the desired thickness or until the metal ions are depleted from solution. Deposition rates vary under the conditions of the present process from about 0.1 mil (1 mil=one one-thousandth of an inch) to about 1.5 mil per hour. The preferred plating rate is about 1 mil per hour.

One gallon of bath prepared in accordance with the preferred embodiment of the present invention will coat approximately 144 square inches to a thickness of 1 mil. For this result to be achieved the bath is replenished with the needed ingredients as these ingredients are depleted from solution.

The pH of the coating bath will tend to drop during the coating process and should be checked periodically to assure that it is within the preferred pH range of about 12 to about 14. It as been found that any problems with pH maintenance throughout the use of a coating bath can be minimized simply by using a highly alkaline (concentrated sodium hydroxide) solution of borohydride to replenish the borohydride content of the bath as required. The coating deposition rate from the present electroless coating bath is about 0.1 to about 1.5 mil per hour and is dependent on the bath temperature, pH, and metal ion concentration. The deposition rate on most metal substrates from freshly prepared coating baths at a preferred temperature of about 185 to about 195° F. is approximately 1 mil per hour.

The practical aspects for carrying out electroless coating processes and conventional nickel/boron baths and stabilizers can be in the art. Such processes and compositions are disclosed generally in U.S. Patents directed to nickel plating.

The electroless nickel coatings of the present invention can exhibit excellent hardness and concomitant wear resistance or abrasive properties. They can be highly ductile allowing the coating to flex with the substrate while maintaining a strong bond to the coated material.

The present coatings have a wide range of applications, which will be recognized by those skilled in the art. They have particular utility for coating surfaces of articles that under normal use are subjected to highly abrasive, rubbing, or sliding conditions under high temperatures/pressures. Such high wear conditions are found at many points in the construction of tools, internal combustion engines including gas turbine engines, transmissions and in a wide variety of heavy equipment construction applications. Also the coatings can be used as an abrasive.

The examples provide details of bath compositions, process conditions, and coating compositions and properties representative of the present invention. The examples are illustrative of the invention and are not in any way to be taken as limiting the scope thereof.

The, following examples were done to show the effect of using different dispersing compositions in the same alkaline bath. The baths were usually run for 4 hours unless plate out occurred. All the baths were agitated and heated to the proper temperature on a magnetically stirred hot plate. Each dispersing composition was added with a fresh bath, brought to a temperature of 192° F., then the dispersing composition was added then the reducer with stabilizer.

The procedure for making the plating bath was as follows.

1. A one gallon bath minus 375 milliliters to be added later having the following composition was made.
   a) 90 grams of nickel chloride
   b) 227 mls of EDA (ethylenediamine)
   c) 150 grams of sodium hydroxide
   d) balance was dionized water about 3000 ml
2. The bath was heated to about 192° while stirring
3. A dispersion composition was added to the bath.
4. A test sample was prepared by cleaning with detergent, rinsed two times and pickled in 30–50% HCl for 1–2 minutes and then rinsed. The thickness of the test panel was measured with a micrometer.
5. Ten milliliters of reducing solution was mixed with 10 milliliters of a stabilizing solution and then this mixture was added to the bath. The reducing solution was made by mixing 1 gram sodium borohydrite and 2.5 gram sodium hydroxide with water until the volume reached ten milliliters. The stabilizing solution was made by mixing with 26 milligrams of lead tungstate, 2% by volume EDA and sufficient sodium hydroxide to reach a pH of 11, with the balance water
6. The panel was placed in the bath and the time was recorded. Every 30 minutes the panel was removed from the bath and the thickness measured.

EXAMPLE 1

The dispersion composition added was untreated 1–10 micron particles of baron carbide to the agitated bath caused unacceptable amounts of the particles to be available for co-deposition. Most of the particles drop out of suspension.

EXAMPLE 2

The dispersion was 375 mls of a composition having 100% EDA and 0.12 grams of boron carbide particles having a pH of 8.2 and agitated was added to the bath. 20%-of the particles plated out in the tank.

EXAMPLE 3

The dispersion was 375 mls of a composition having 100% of a sodium salt of EDTA and 0.12 boron carbide particles having a pH of about 8 was added to the bath. The particles remain in suspension, However the plating was unacceptable

EXAMPLE 4

The dispersion was 375 mls of a composition having 50% of a sodium salt of EDTA and 50%ETA and 0.12 grams of boron carbide particles having a pH of 8 was added to the bath. The particles remained in suspension but the plating rate was 8–11 microns per hour.

EXAMPLE 5

Example 4 was repeated with addition of sodium hydroxide to rise the PH to 11. Very little particles in the coating. Plating nearly stopped, less then one micron per hour.

EXAMPLE 6

A beaker containing 375 mls of a composition having 25% of a sodium salt of EDTA and 50%ETA and 0.12 grams of boron carbide particles and 25% water having a pH of 8 was added to the bath. The plating rate improved over example 5. However, 5–10% of the particles dropped out of suspension.

EXAMPLE 7

A beaker containing 375 mls of a composition having 25% of a sodium salt of EDTA and 50%ETA and 0.12 grams of boron carbide particles and 25% water and sufficient sodium hydroxide to raise the pH to 11. The plating rate averaged 25.5 microns over 5 hours. No substantial amount of the particles dropped out of suspension. Other particles such as molly or tungsten disulfide, Teflon (PTEF), diamonds, or silica carbide were successfully substituted for the boron carbide particles. Particles of up to 60 microns were successfully substituted for the boron carbide particles.

It is well known in the electroless metal plating art that solid particles can be co-deposited in nickel/phosphorus coating to change the properties of the coating. Particulate material such as diamond, silica carbide or Teflon or molly or tungsten disulfides have been used. The problem in the art is these co-deposited particles have poor bond strength and tend to separate from the nickel coating. This is thought to be due to the volume of particles lying at the interface of the nickel coating and the substrate thereby causing voids between the nickel coating and the substrate. This is can be seen under a cross section examination of the coating using a scanning electron microscope.

Examples 8–16 were the same as Example 7 but with different amounts of a sodium salt of EDTA and EDA and water in the dispersing composition. The amounts of a sodium salt of EDTA and EDA and the results are shown in the following Table.

TABLE

| Example | EDA | EDTA | Water | Coating Properties |
|---|---|---|---|---|
| 8 | 50% | 35% | 15% | plated at 19.5 microns/hour but short life |
| 9 | 50% | 30% | 20% | good |
| 7 | 50% | 25% | 25% | good |
| 10 | 50% | 15% | 35% | good |
| 11 | 50% | 10% | 40% | plate out started; 25 percent seeding |
| 12 | 75% | 25% | 25% | plating rate 20.8 micron/hour but slowing |
| 13 | 60% | 25% | 15% | good |
| 14 | 40% | 25% | 35% | good |
| 15 | 35% | 25 | 45% | plate out after 45 minutes |
| 16 | 25% | 25% | 50% | plate out started in first ½ hour |

These examples show that the dispersing composition can have a concentration range of EDA from about 35% to about 75% by volume. The preferred range is about 40% to less then 75%. For EDTA the concentration can range from greater than 10% to less than 35% volume. The preferred range is about 15% to about 30% by volume.

To show the effect on the coating process when greater amount of dispersing composition of example 7 was added to the bath, 400, 450 and 500 milliliters of the dispersing composition in Example 14 was added to the bath. The water content of the bath was adjusted so when the dispersing composition is added to the bath the bath volume is 1 gallon. No change in coating properties occurred when 400 and 450 milliliters of the dispersing composition were added to the bath. When 500 mls were added the coating slowed down to an unacceptable amount. These examples showed that a one gallon plating bath dispersing composition having 125 mls (500×25%) can cause unacceptable plating. This appears to correspond to example 8 where 131 ml of EDTA produced an unacceptable bath.

The following examples show the volumetric loading of particles in a nickel boron coating using a dispersing composition having different amount of particles in a bath. The bath and the dispersing composition was the same as in example 7.

EXAMPLE 18

A 375 mls, dispersing composition having 50%EDA and 25% of a sodium salt of EDTA, 0.12 grams per gallon of boron carbide particles an alkaline agent to adjust the pH to 11 was added to the plating bath. The water content of the bath was adjusted so when the dispersing composition is added to the bath the bath volume is 1 gallon.

By volume the amount of boron carbide particle in the coating was about 35%. Increasing the amount of particles in the dispersing composition to 0.22 grams per gallon increased the volumetric amount to about 37½% with fall out starting. Decreasing the amount of particles to 0.08 grams per gallon decreased the volumetric amount of the particles in the coating to about 24%. Decreasing the amount of particles to 0.04% grams per gallon decreased the volumetric amount of the particles in the coating to about 12%.

The wear test conditions are:

1) All samples were polished to a surface finish value of less than 10 RMS micron.
2) A 10 pounds load was constant and equal in each test
3) The speed rate was a constant 1700 RPMS.
4) The abrasive was, 0,250" in diameter.
5) Each study was performed @ 204 lb/inch$^2$ @ 111.2 feet per minute.
6) Fresh, white mineral oil was used as a lubricant.
7) The sample thickness was measured and recorded at the beginning, of the run and every 15 minutes for the duration,
8) All runs were 4 hours in duration minus inspection intervals.
9) The abrasive material was a number 4, solid tungsten carbide insert.
10) A calibrated micrometer was used to measure the samples always measuring in the center of the wear pattern. The micrometer shaft has a diameter of 0.180" and reads in increments of 0.00005 inches.

| | Mass Loss | | | | | | | | |
|---|---|---|---|---|---|---|---|---|---|
| | Time In Minutes | | | | | | | | |
| | 0 | 15 | 30 | 45 | 60 | 75 | 90 | 105 | 120 |
| Table 1 | 0.03900 | 0.03870 | 0.03860 | 0.03845 | 0.03840 | 0.03830 | 0.03825 | 0.03820 | 0.03810 |
| Table 2 | 0.03900 | 0.03880 | 0.03870 | 0.03865 | 0.03860 | 0.03860 | 0.03850 | 0.03850 | 0.03845 |
| Table 3 | 0.03900 | 0.03885 | 0.03875 | 0.03870 | 0.03865 | 0.03860 | 0.03855 | 0.03850 | 0.03850 |
| Table 4 | 0.03900 | 0.03895 | 0.03895 | 0.03895 | 0.03895 | 0.03895 | 0.03895 | 0.03895 | 0.03895 |
| Table 5 | 0.03900 | 0.03870 | 0.03845 | 0.03830 | 0.03790 | | | | |
| Table 6 | 0.03900 | 0.03880 | 0.03865 | 0.03860 | 0.03850 | 0.03835 | 0.03825 | 0.03815 | 0.03805 |
| Table 7 | 0.03900 | 0.03890 | 0.03880 | 0.03875 | 0.03870 | 0.03865 | 0.03865 | 0.03860 | 0.03855 |

| | Mass Loss | | | | | | | |
|---|---|---|---|---|---|---|---|---|
| | Time In Minutes | | | | | | | |
| | 135 | 150 | 165 | 180 | 195 | 210 | 225 | 240 |
| Table 1 | 0.03790 | | | | | | | |
| Table 2 | 0.03840 | 0.03835 | 0.03825 | 0.03815 | 0.03805 | 0.03795 | | |
| Table 3 | 0.03850 | 0.03845 | 0.03845 | 0.03840 | 0.03840 | 0.03835 | 0.03835 | 0.03830 |
| Table 4 | 0.03895 | 0.03895 | 0.03895 | 0.03895 | 0.03895 | 0.03895 | 0.03895 | 0.03895 |
| Table 5 | | | | | | | | |
| Table 6 | 0.03790 | | | | | | | |
| Table 7 | 0.03850 | 0.03850 | 0.03845 | 0.03840 | 0.03840 | 0.03835 | 0.03835 | 0.03835 |

Note: Panel thickness before plating 0.03800"

This showed that the volumetric amount of particles in the coating is proportional to the amount by weight of particles in the bath. A 33% change in weight appears to produces a 33% change in volumetric loading.

The use of co-deposited particles in a nickel/boron coating without any heat treatment provides wear resistance that can exceed heat treated nickel/boron coatings. The following examples show a comparative wear test using a nickel/boron coating with various co-deposited particles with or with out heat treatment and a well known, beat-treated and non heat treated nickel/boron coating. The coating used for this test was the same as in example 7 with and with out co-deposited particles.

Table 1 shows the wear resistance in term of change in thickness overtime of is a commercially available non heat treated nickel boron coat. The coating failed after 135 minutes. Table 2 shows that the coating in Table 1 having been heat treated at 725 F. for 90 minutes increases the wear resistance. The creation of the nickel boride crystal provided by the heat treatment causes the increase in wear resistance. Table 3 shows the same coating as in Table 1 with out an heat treatment having co deposited boron carbide particles has superior wear resistant properties. Table 4 shows the same coating as in Table 1 with out a heat treatment with a co-deposited 1–3 micron diamond particles having superior wear resistant properties. Heat treatment of the nickel boron coating with co-deposited particles at 725 F. for 90 minutes improved the wear resistance by 15%.

These examples show that wear resistance of nickel/boron coating with co-deposited particles are superior then conventional heat treated nickel/boron coating. And that when using other particles such as diamonds improved properties would be expected. Also upon examination of the coating, the co deposition of the particles allows more particles to be present in the coating then found after heat treatment. This enhances the wear resistance of the coating.

The ability to use nickel/boron plating baths that are normally spent and achieve satisfactory coatings is demonstrated by the following examples.

EXAMPLE 19

Comparative examples were performed with a well known, conventional nickel boron bath utilizing thallium sulfate as the stabilizer. The thallium content of the bath was intentionally high and the boron content low. This is typical of an aged bath of about 13 metal turnovers. With low boron and high thallium in the bath the coating would have insufficient boron, for heat treatment to produce the requisite nickel boride crystals to produce the desirable wear resistance properties. This bath produced a uniform coating that appear to be good but lacks the wear resistant properties. Table 5 shows the wear resistance of this coating as plated with out heat-treatment. Table 6 shows the improved after heat-treating at 725 F. for 90 minutes. Table 7 shows the improved wear resistance over the heat treated coating in Table 6 using the co-deposited boron carbide particles. The dispersing composition of example 7 was added used to introduce the boron carbide particles into the bath.

EXAMPLE 20

A bond test was performed to ASTM-571-97 Bend Test. A coated panel is bent over a ⅜ inch mandrill to 180° without the coating flaking off ATSGDH. The test compared the bond strength of a nickel boron coating to a nickel boron coating having co-deposited particles such as boron carbide, diamonds and tungsten disulfide. The results of the test showed no obvious degradation in bond strength between nickel boron and nickel boron co-deposited particles deposited in coating and without co-deposited particles. The composition of example 7 was used to make the nickel/boron coatings with and with out the dispersing composition.

With respect to the above description then, it is to be realized that the optimum proportions, process steps, and ingredients of the invention, to include variations in size, materials, shape, form, function and manner of operation, assembly and use, and deemed readily apparent and obvious to one skilled in the art, and all equivalent relationships to those described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Now that the invention has been describe

What is claimed is:

1. A coating bath for providing a hard, wear and corrosion resistant, ductile coating on a substrate, said bath having a pH of about 10 to about 14 and comprising (1) an effective amount of nickel ions,
(2) an effective amount of a stabilizer,
(3) an effective amount of a metal ion complexing agent in an amount sufficient to inhibit precipitation of said metal ions from the coating bath,
(4) an effective amount of a borohydride reducing agent,
(5) optionally other metal ions; and
(6) an effective amount of an alkaline dispersing composition comprising particles and a mixture of a water soluble salt of ethylenediamine tetraacetic acid (EDTA) and ethylenediamine (EDA).

2. The coating bath of claim 1, wherein the soluble salt is a sodium salt.

3. The coating bath of claim 1, wherein the alkaline dispersing compositions has pH greater then 10.

4. The coating bath of claim 3, wherein the alkaline dispersing compositions has pH of about 11.

5. The coating bath of claim 1 wherein the weight of particles in the bath range between about 0.05 to about 0.15 grams per gallon.

6. The coating bath of claim 1 wherein the maximum size of the particles is limited by the ability of the bath to maintain the particles in suspension and codeposit in the coating.

7. The coating bath of claim 5 wherein the particle size is about 60 microns or less.

8. The coating bath of claim 1 wherein the concentration ranges of EDA and the water soluble salt EDTA in the dispersing composition per gallon of bath is from about 35% to about 75% by volume EDA and from greater than 10% to about 35% by volume EDTA with the proviso that the maximum water soluble salt of EDTA in the bath is no more than 131 mls per gallon of bath.

9. The coating bath of claim 8 wherein the concentration ranges of EDA and the water soluble salt of EDTA in the dispersing composition per gallon of bath is from about 40% to about 75% by volume EDA and from about 15% to about 30% by volume of a water soluble salt of EDTA with the proviso that the maximum water soluble salt of EDTA in the bath is no more than 125 mls per gallon bath.

10. The coating bath of claim 1 wherein the particles are selected from the group consisting of diamonds, boron carbide, molly or tungsten disulfide and silicon carbide.

11. An aqueous dispersing composition having a pH greater than 10 comprising a mixture of a water soluble salt of EDTA and EDA and particles wherein the concentration ranges are from about 35% to about 75% by volume EDA and from 10% to about 35% by volume of the water soluble salt of EDTA.

12. An aqueous dispersing composition according to claim 11 having a pH of about 11 comprising a mixture of a water soluble salt of EDTA and EDA and particles wherein the volumetric concentration ranges are from about 40% to about 75% by volume EDA and from about 15% to about 30% by volume of the water soluble salt of EDTA.

13. An aqueous dispersing composition according to claim 11 wherein the particles are selected from the group consisting of diamonds, boron carbide, molly or tungsten disulfide and silicon carbide.

14. A concentrate comprising a mixture of a water soluble salt of EDTA and EDA wherein the volumetric concentration ranges of EDA and the water soluble salt of EDTA upon dilution provides about 35% to about 75% by volume EDA and from 10% to about 35% by volume the water soluble salt of EDTA.

15. A concentrate according to claim 14 comprising a mixture of a water soluble salt of EDTA and EDA wherein the volumetric concentration ranges of EDA and the water soluble salt of EDTA upon dilution provides about 40% to less than 75% by volume EDA and from 15% to about 30% by volume of the water soluble salt of EDTA.

16. A concentrate according to claim 14 comprising an alkaline adjusting agent.

17. A concentrate according to claim 14 comprising particles.

18. An nickel boron alloy coating having particles dispersed through the coating where in the volumetric amount of the particles in the coating is 37½% or less.

19. A nickel boron alloy coating according to claim 18 having particles dispersed through the coating where the wear resistance of the coating is greater than the wear resistance of the nickel boron coating.

20. A nickel boron alloy coating according to claim 18 where the coating has been heat treated.

21. A nickel boron alloy coating according to claim 18 having about 85 to about 99.5 weight percent nickel, about 0.5 to about 10 weight percent boron wherein the coating is continuous and uniform.

22. A nickel boron alloy coating according to claim 18 having an interfacial layer free of particles.

23. A nickel boron alloy coating according to claim 22 where the interfacial layer is about 1–3 microns.

24. A process of producing a nickel/boron coating by a chemical reduction using a borohydride reducing agent comprising inserting an article in the coating bath of claim 1 and depositing the coating.

25. A process according to claim 24 wherein the coating is heat treated.

26. The product by process of claim 24.

27. The product by process of claim 25.

28. The coating bath according to claim 1 wherein the bath is formed by combining the ingredients (1), (2), (3), (4) (6) and optionally (5).

* * * * *